US005690175A

United States Patent [19]

Jones

[11] Patent Number: 5,690,175

[45] Date of Patent: Nov. 25, 1997

[54] WELL TOOL FOR GRAVEL PACKING A WELL USING LOW VISCOSITY FLUIDS

[75] Inventor: Lloyd G. Jones, Dallas, Tex.

[73] Assignee: Mobil Oil Corporation, Fairfax, Va.

[21] Appl. No.: 606,474

[22] Filed: Mar. 4, 1996

[51] Int. Cl.[6] ..... E21B 43/04

[52] U.S. Cl. ..... 166/278; 166/51

[58] Field of Search ..... 166/276, 278, 166/51, 228

[56] References Cited

U.S. PATENT DOCUMENTS

| | | | |
|---|---|---|---|
| 2,173,119 | 9/1939 | Layne | 166/51 |
| 3,262,499 | 7/1966 | Fleming | 166/51 X |
| 3,884,301 | 5/1975 | Turner et al. | 166/278 |
| 4,685,519 | 8/1987 | Stowe et al. | 166/278 |
| 4,945,991 | 8/1990 | Jones | 166/278 |
| 5,027,899 | 7/1991 | Grubert | 166/278 |
| 5,113,935 | 5/1992 | Jones et al. | 166/51 |
| 5,161,613 | 11/1992 | Jones | 166/242.3 |
| 5,161,618 | 11/1992 | Jones et al. | 166/308 |
| 5,333,688 | 8/1994 | Jones et al. | 166/278 |
| 5,339,895 | 8/1994 | Arterbury et al. | 166/227 |
| 5,417,284 | 5/1995 | Jones | 166/280 |
| 5,419,394 | 5/1995 | Jones | 166/51 |
| 5,435,391 | 7/1995 | Jones | 166/308 |
| 5,560,427 | 10/1996 | Jones | 166/280 |

FOREIGN PATENT DOCUMENTS

| | | | |
|---|---|---|---|
| 1521865 | 11/1989 | U.S.S.R. | 166/51 |

*Primary Examiner*—David J. Bagnell
*Attorney, Agent, or Firm*—Malcolm D. Keen

[57] ABSTRACT

A method and well tool for using a low-viscosity slurry to gravel pack an interval. The well tool is comprised of a conduit which includes a main screen and an upper by-pass screen. The tool is lowered into the interval and slurry is pumped into the annulus around the screen whereby the fluid from the slurry is lost into casing perforations while the gravel falls to the bottom of the annulus to form the gravel pack. When the gravel rises above the uppermost perforations, fluid from the slurry by-passes the gravel pack by flowing into the by-pass screen, through a washpipe in the conduit, and out the lower end of the main screen to thereby pack perforations in the casing and to improve the gravel distribution of the gravel pack within the annulus.

5 Claims, 3 Drawing Sheets

WELL TOOL FOR GRAVEL PACKING A WELL USING LOW VISCOSITY FLUIDS

DESCRIPTION

1. Technical Field

The present invention relates to gravel packing a wellbore and in one of its aspects relates to a method and well tool for gravel packing an interval within a wellbore using a low viscosity fluid wherein a good distribution of gravel is achieved across the entire interval and also within the casing perforations which lie within the interval.

2. Background

In producing hydrocarbons or the like from loosely consolidated and/or fractured subterranean formations, it is not uncommon to produce large volumes of particulate material (e.g. sand) along with the formation fluids. As is well known, these particulates routinely cause a variety of problems and must be controlled in order for production to remain economical. Probably the most popular technique used for controlling the production of particulates (e.g. sand) from a producing formation is one which is commonly known as "gravel packing".

In a typical gravel pack completion, a screen or the like is lowered into the wellbore and positioned adjacent the interval of the well which is to be completed. Particulate material, collectively referred to as "gravel", is then pumped as a slurry down a workstring and exits above the screen through a "cross-over" or the like into the well annulus around the screen and hopefully into the perforations in the well casing which lie within the producing interval.

The liquid in the slurry is lost through the perforations in the casing and into the formation and/or flows through the openings in the screen thereby resulting in the gravel being deposited or "screened out" in the annulus around the screen. The gravel is sized so that it forms a permeable mass or "pack" between the screen and the producing formation which, in turn, allows flow of the produced fluids therethrough and into the screen while substantially blocking the flow of any particulate material therethrough.

Wherever possible, it is often advantageous to use low-viscosity fluids (e.g. water, thin gels, or the like) as the carrier fluid to fracture the formation and to form the gravel slurry since such slurries are inexpensive, do less damage to the producing formation, give up the gravel more readily than do those slurries formed with more viscous gels, and etc.

For example, when a low-viscosity slurry is used to gravel pack an interval in a near-vertical well (i.e. inclined at 50° or less), the gravel can easily separate from the slurry and fall under the influence of gravity to the bottom of the annulus as the low-viscosity fluid is lost from the slurry. While this usually results in a forming a good gravel pack within the annulus from the bottom up, unfortunately in many instances, the perforations in the casing, especially those adjacent the bottom of the interval, are often poorly packed because the pressure gradient across the perforations is usually too small to carry gravel into the perforations.

All of these factors normally produce poor perforation packing which, in turn, often results in poor productivity from the formation. Further, any fracturing of the formation caused by the low-viscosity slurry during the gravel pack operation is normally confined to the upper end of the completion interval with little or no fracturing occurring through the perforations at the lower or bottom end of the interval.

Another problem with high-rate, low-viscosity gravel packing/fracturing occurs when the pack of gravel rises in the annulus to a point just above the top perforations in the casing and/or above the top of the screen. The fluid no longer has any place to go whereupon the resulting, high pump rates are likely to then create sand-out pressures high enough to destroy the mechanical integrity of the top of the screen. It is believed that this results from the pressure in the annulus at the top of the interval becoming high enough to push some of the pack through adjacent perforations into the formation, thereby creating a void in the pack which, in turn, is then filled by gravel from the pack above the void.

When this happens, the pack will slide downward on the casing side of the annulus but, since the gravel may actually impinge into the screen, the pack on the screen side is not free to slide downward as readily as at the casing side. Nevertheless, the pumping pressures are normally high enough to force both sides of the pack downward, thereby shearing the screen away from its base pipe and thus destroying the integrity of the screen. This can have catastrophic consequences if not discovered immediately; i.e. resulting in a workover at a minimum or blow-out of the well at the worst.

SUMMARY OF THE INVENTION

The present invention provides a method and a well tool for gravel packing an interval within a wellbore which provides (a) a good distribution of gravel across the interval and (b) good packing of the perforations within the interval while using a low-viscosity slurry. Basically, the gravel packing/fracturing operation of the present invention is initially carried out in a routine manner in that a screen is lowered into the interval and a low-viscosity slurry is pumped into the top of the annulus around the screen whereby the fluid is lost from the slurry into the perforations in the well casing or through the screen while the gravel from the slurry falls under gravity to the bottom of the annulus to thereby form a pack of gravel.

When the gravel pack rises above the perforations in the casing, fluid is now "lost" from the slurry and by-passes the gravel pack by flowing into the upper end of the screen, through a washpipe and out the lower end of the screen to thereby further pack perforations in the well casing and to improve the gravel distribution of the gravel pack.

More specifically, the present invention provides a well tool which is comprised of a conduit adapted to be connected to the lower end of a work string. The conduit includes a lower main screen which is adapted to lie adjacent the wellbore interval which is to be gravel packed and those casing perforations which lie within the interval. The conduit also includes an upper or by-pass screen section which lies above the main screen and the perforations in the well casing. The by-pass screen is adapted to allow fluid from the slurry to flow into said well tool while blocking flow of particulates.

A washpipe is positioned within the conduit and extends through the completion interval. The washpipe has inlet openings therein which lie adjacent the upper by-pass screen section and a means thereon below said inlet openings for blocking flow between said washpipe and said conduit. In one embodiment of the well tool, the upper, by-pass screen is comprised of a separate screen which is positioned in the conduit above the lower main screen. In another embodiment, the upper by-pass screen is merely an extended portion of said main screen which will extend a substantial distance (e.g. 10 feet or more) above the perforations in the casing.

In operation the well tool is lowered into the wellbore and is positioned adjacent the interval to be completed. A slurry comprised of a low-viscosity carrier fluid (e.g. 30 centipoises or less) and gravel is flowed down into the well annulus which exists between the well tool and the well casing. As the slurry enters the annulus, the low-viscosity fluid is lost substantially through the perforations in the casing or through the screen while the gravel falls to the bottom of the annulus to form a pack of gravel around said well tool.

Continued flow of the slurry after the pack of gravel rises above the uppermost perforations in the casing will result in the low-viscosity fluid from said slurry entering the upper by-pass screen and the inlets in the washpipe to flow downward through the interior of said well tool. The fluid then passes from the lower portion of the well tool back into the lower portion of the annulus through the lower main screen. This fluid carries gravel from the pack into perforations which may have been poorly packed during the original placement of the pack and will also aid in consolidating the gravel pack in the annulus. Voids caused by the fluid removing gravel from the pack will be filled by the reshifting of the gravel in the pack (i.e. gravel above the voids will move downward into the voids while that gravel is replaced by the grave which continues to be deposited on the top of the pack during the by-passing of the fluid).

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
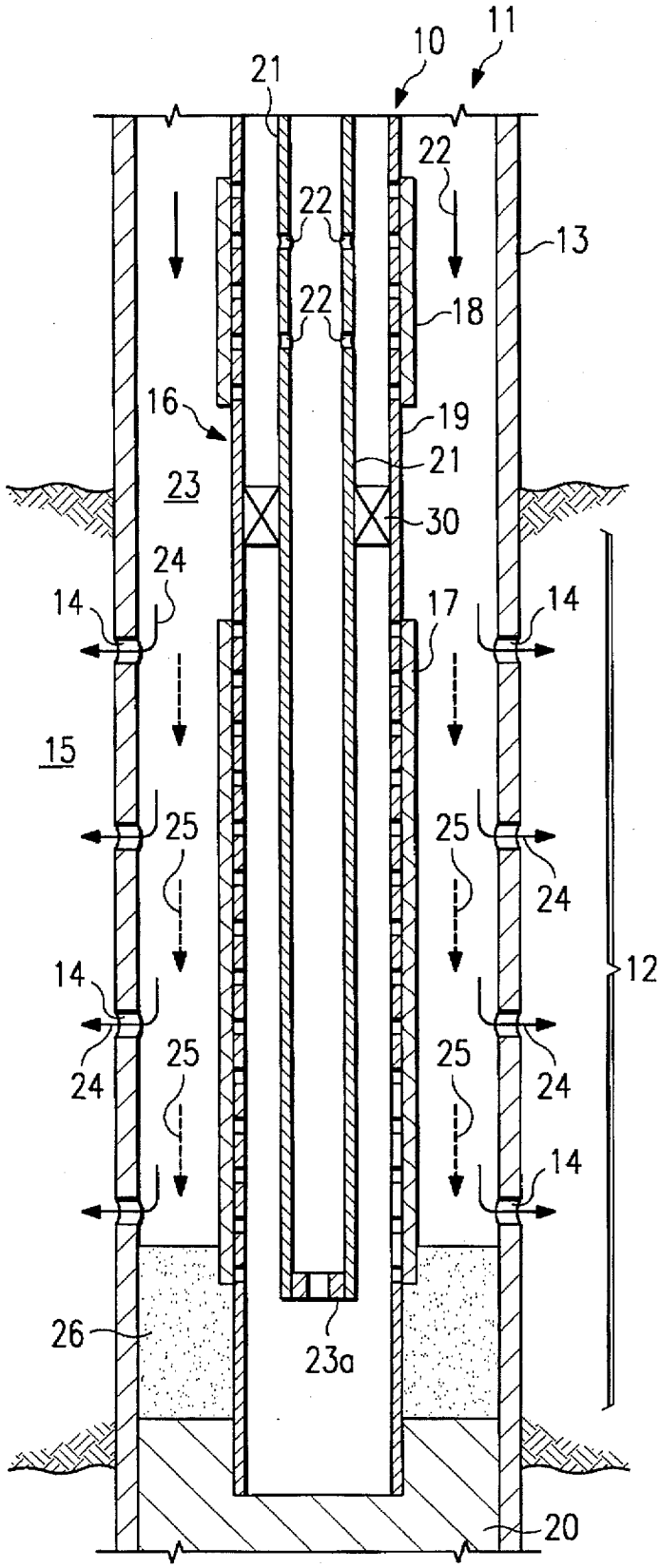
FIG. 1 is a sectional view of the lower end of a wellbore illustrating the initial steps of a method of gravel packing a wellbore interval in accordance with the present invention.

Referring more particularly to the drawings, FIG. 1 illustrates a well tool 10 used for carrying out the present invention when it is positioned within wellbore 11 in an operable position adjacent an interval 12 which is to be gravel-packed. As will be understood, wellbore 11 has a casing 13 therein which has been cemented (not shown) in place. Casing 13 has a plurality of perforations 14 which fluidly communicate the wellbore with a formation 15 which lies adjacent the wellbore interval which is to be completed.

Well tool 10 comprises a conduit 16 which is adapted to be connected to the lower end of a workstring (not shown). The term "screen" as used throughout the present specification and claims is meant to refer to and cover any and all types of permeable structures commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof).

Figure 2:
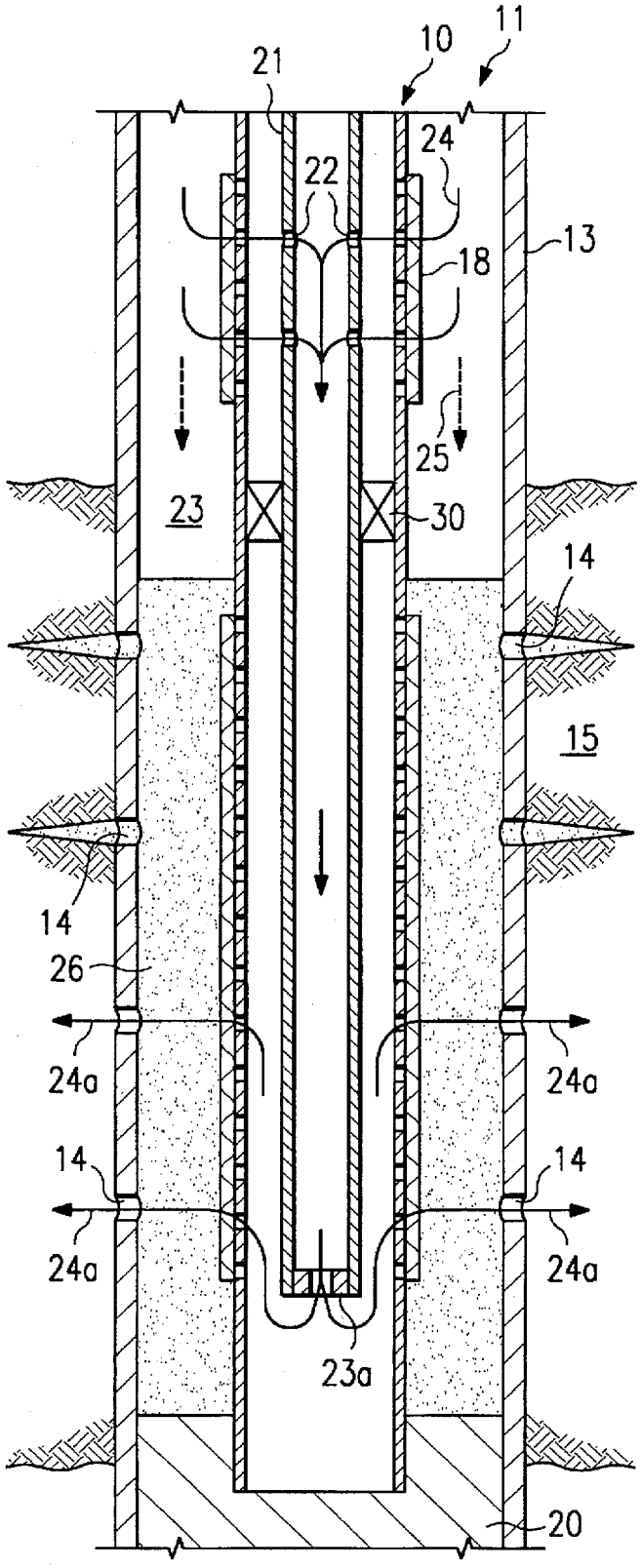
FIG. 2 is a sectional view of the wellbore of FIG. 1 illustrating the final steps of the present gravel packing method.

Conduit 16, as illustrated in FIGS. 1 and 2, is seated into a well plug 20 or the like (FIGS. 1 and 2) or directly into the the bottom of the wellbore (FIG. 3), as the case may be, and includes a lower permeable section (e.g. main screen 17) and an upper permeable section (e.g. by-pass screen 18). As shown, the upper and lower screens are separated by a "blank" section(s) 19; however, in some instances, the lower screen section 17 may merely be extended substantially above the uppermost perforations 14 in casing 11 (e.g. by a 10-foot joint or more) which would eliminate the need for blank section(s) 19 and separate by-pass screen 18 (e.g. see the extended screen 17*a*in FIG. 3).

A washpipe 21 having inlet openings 22 near its upper end extends downwardly through lower screen section 17. A packer 30 is positioned on washpipe 21 to block flow between washpipe and screen 16. It should be understood that in some instances, washpipe 21 may be sized to provide almost no clearance with screen 16, in which case, packer 30 could be eliminated.

As illustrated, a choke 23*a* is positioned in washpipe 21 to control flow therethrough but it is pointed out that a rupture disk or other valve means (not shown) can be used in place of the choke as will be more fully discussed below. Conduit 16 preferably fluidly cooperates with a well-known "cross-over" and a packer (neither shown) on the workstring (not shown) so that fluid flowing down the workstring will exit into the annulus below the workstring packer, this being well known and common in this art.

In carrying out the method of the present invention, well tool 10 is lowered into wellbore 11 and is positioned adjacent interval 12. A slurry (heavy arrows 22 in FIG. 1) comprised of a low-viscosity carrier fluid and "gravel" (e.g. particulates such as sand, etc.) is pumped down the workstring, through a cross-over, and into the upper end of annulus 23 which surrounds well tool 16 throughout the interval 12. As used herein, "low-viscosity" is meant to cover fluids which are commonly used for this purpose and which have a viscosity of 30 centipoises or less (e.g. water, low viscosity gels, etc.).

As slurry 22 enters annulus 23, the carrier fluid (light arrows 24) will be "lost" from the slurry and will flow through perforations 14 under pressure into formation 15 where it is likely to cause beneficial fracturing of the formation. The majority of the gravel (dotted arrows 25) separates from the slurry and, under the influence of gravity, falls down annulus 23 where it accumulates to form a "pack" of gravel 26 (FIG. 2) within interval 12. As will be recognized, a small amount of the separated carrier fluid may also enter by-pass screen section 18 and flow through openings 22 and into washpipe 21. However, choke 23*a* substantially restrict flow from the lower end of washpipe 21 so that the bulk of the fluid will continue to flow through casing perforations 14 into formation 15. Further, if desired, as mentioned above, a rupture disk or other type valve (not shown) can be used to completely block flow through washpipe 21 until a predetermined pressure is reached within the washpipe.

The initial pumping of slurry will continue until the pack 26 builds up and rises above the uppermost perforations 14 in casing 13 which is also above the lower or main screen section 17. As fluid access to the lower portion of the interval is reduced or eliminated by the pack 26 covering both the lower screen section 17 and perforations 14, the pressure in the annulus 23 quickly rises as fluid tries to reach the perforations 14 or screen section 17 through the advancing gravel pack 26. While theoretically the gravel in pack 26 should now be equally distributed over its entire length (i.e. across interval 12), often this is not the case in actual completions of this type. Experience has indicated that while the perforations may be adequately packed at the top, they are usually poorly packed lower in the interval: especially those perforations 14 which lie near the lower end of interval 12.

The present invention allows the use of low-viscosity fluids to pack interval 15 while substantially improving the distribution of the gravel both within the perforations 14 and across the entire completion interval 12. As best seen in FIG. 2, the flow of slurry will continue as before even after the upper perforations 14 and lower screen section 17 are covered by pack 26. Gravel will still separate from the slurry and will be deposited onto the top of pack 26.

However, by-pass screen 18 now becomes dominant in providing fluid access to the lower portion of interval 12. That is, the low-viscosity fluid from the slurry will by-pass pack 26 by passing through upper screen section 18, inlet openings 22, and out the lower end of washpipe 21. If a rupture disk or pressure-actuated valve is used in place of choke 23*a*, the pressure in washpipe 21 will quickly exceed that required to rupture the disk or open the valve whereby fluid can then flow out of washpipe 21. It is noted that the bypassing fluid will flow through washpipe 21 at the same pressure as that which exists in the annulus 23 above pack 26.

The fluid (arrows 24*a* in FIG. 2) from washpipe 21 then exits through the lower or main screen 17 section and flows under pressure through the loosely consolidated lower end of pack 26 and into the lower poorly-packed perforations 14. As the fluid is forced through the perforations, it carries gravel from pack 26 into those perforations which were not adequately packed initially. As gravel is pushed or carried through perforations 14 and into formation 15, gravel from the pack will move downward to fill any voids created thereby with this gravel, in turn, being replenished by the gravel being deposited at the top of the pack. Also, as will be recognized by those skilled in this art, the low-viscosity fluid may also cause some beneficial fracturing of the formation, both in this step and initially, as it enters the formation. These fractures will also be packed as the fluid carries the gravel from the pack into these fractures.

Due to the fluid by-pass provided by bypass screen 18 and inlet openings 22 in washpipe 21, the fluid pressure above pack 26 does not escalate as rapidly when the gravel in pack 26 covers the upper end of screen and the upper perforations in the casing thereby alleviating or eliminating the possibility of serious damage to the top of main screen section 17.

Figure 3:
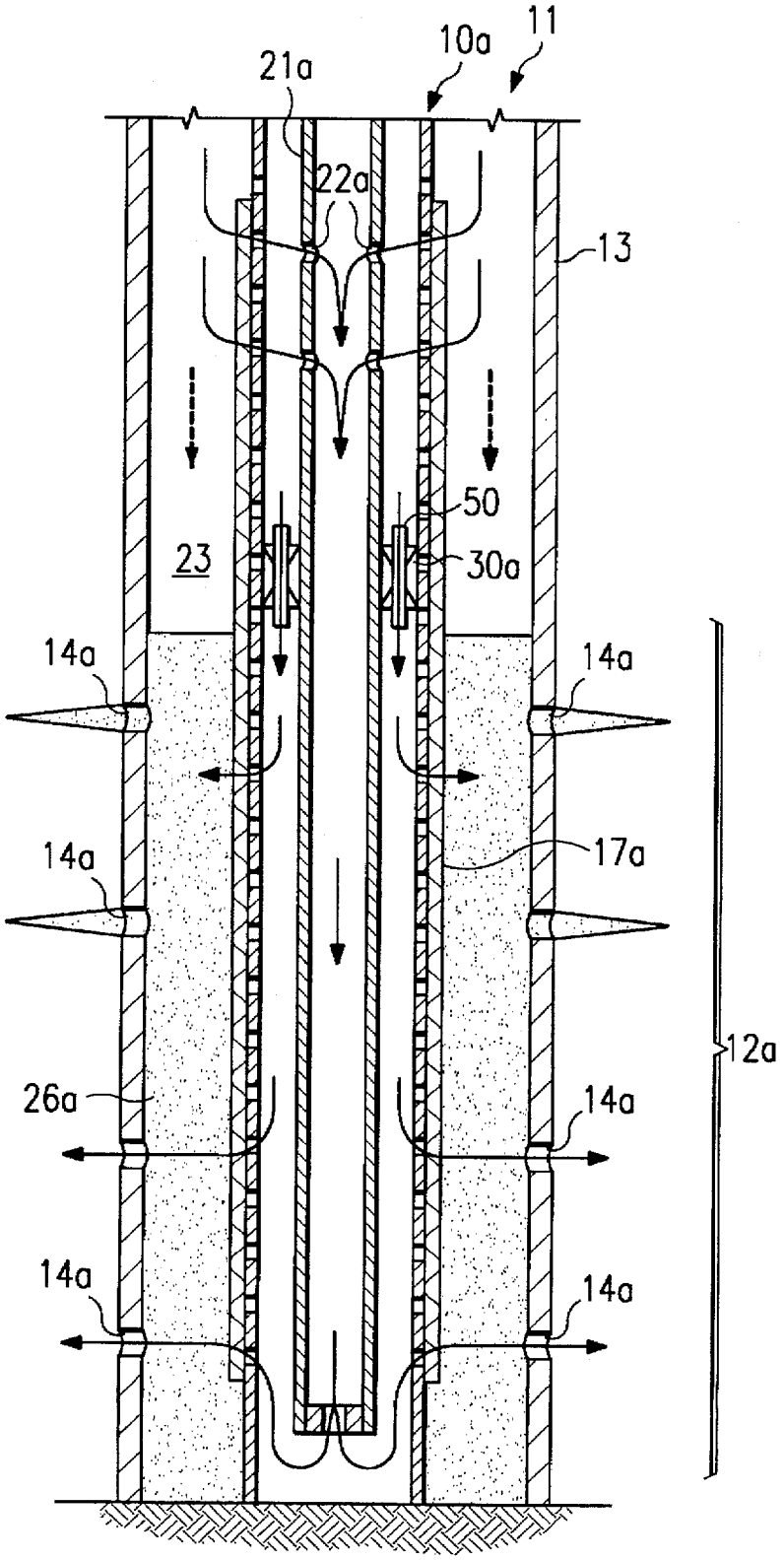
FIG. 3 is a sectional view of a wellbore similar to that of FIG. 1 illustrating a further embodiment of gravel pack apparatus for carrying out the present invention.

FIG. 3 discloses a further embodiment of well tool 10*a* which can be used to carry out the present invention. Well tool 10*a* is similar to that discussed above except the upper screen is replaced by extending the main screen section 17*a* so that it lies above the uppermost perforations 14*a* when apparatus 10*a* is in an operable position within wellbore 11*a*. Also, packer 30*a* includes at least one passage 50 which, in turn, is normally closed to flow by valve means (e.g. rupture disks, not shown).

The operation of the embodiment of FIG. 3 is basically the same as described in that well tool 10*a* is lowered within wellbore 10*a* and is positioned adjacent perforations 14*a* which lie within the interval 12*a* to be completed. Note that the upper end of screen 17*a* extends substantially above the uppermost perforation 14*a*. A low-viscosity slurry flows downward into annulus 23*a* whereupon, liquid is lost into the perforations 14*a* and through screen 17*a*. When the pack of gravel 26*a* rises above the uppermost perforations, fluid will continue to pass into the upper portion of screen 17*a* and into washpipe 21*a* through inlets 22*a* to thereby provide a by-pass for the fluid. The fluid will exit from washpipe and out of the lower portion of screen 17*a* to force fluid through the pack 26*a* and into poorly-packed perforations 14*a*, carrying gravel from pack 26*a* therewith as described above.

Also, the pressure within the screen 17*a* will open passages 50 (e.g. rupture disks or the like, not shown) in packer 30*a* which allows additional fluid to flow out screen 17*a* at different levels to further aid in redistributing the gravel (e.g. compact the pack) and thereby insure a good distribution of gravel throughout interval 12*a* and the perforations 14*a*. The flow of slurry continues until the gravel pack rises above the top of the extended screen 17*a* at which time, the pack 26 and all of the perforations 14*a* should be adequately packed. At this time, an increase in the pump pressure will be experienced indicating that the operation will be complete.

Also, it should be recognized that in some instances, openings 22, 22*a* in the respective washpipe 21, 21*a* and the related packer 30 may be eliminated wherein the fluid by-passes the gravel pack in the annulus by merely passing into the tool through the upper permeable section (i.e. upper screen 18 in FIGS. 1 and 2 or extended main screen 17*a* in FIG. 3), down through the interior of the main screen section, and then out into the annulus through the lower portion of the main screen where the fluid performs the same function as described above.

What is claimed is:

1. A well tool for gravel packing an interval within a wellbore having a casing therein which, in turn, has perforations which lie within said interval, said well tool comprising:

a conduit adapted to be connected to the lower end of a work string, said conduit comprising:

a lower main screen adapted to lie within said interval and adjacent said casing perforations when said well tool is in an operable position within said wellbore;

an upper by-pass screen section lying above said main screen, said by-pass screen section positioned above said casing perforations and adapted to allow fluid to flow into said well tool but block flow of particulates therethrough; and means within said conduit for by-passing fluid from said by-pass screen section to the exterior of said conduit adjacent the lower portion of said conduit 1 wherein said means for by-passing fluid comprises:

a washpipe positioned within said conduit and extending through said interval; said washpipe having inlet openings therein which lie substantially adjacent said upper screen section; and means below said inlet openings for blocking flow between said washpipe and said conduit.

2. The well tool of claim 1 wherein said upper by-pass screen section comprises a separate screen section in said conduit.

3. The well tool of claim 1 wherein said upper screen section is comprised of an extended portion of said main screen.

4. The well tool of claim 3 wherein said means for blocking flow between said washpipe and said conduit comprises:

a packer on said washpipe.

5. The well tool of claim 4 including:

at least one passage through said packer.

* * * * *